US012281822B2

(12) United States Patent
Belzowski et al.

(10) Patent No.: US 12,281,822 B2
(45) Date of Patent: Apr. 22, 2025

(54) HEAT EXCHANGER WITH FILTER, FOR REFRIGERANT FLUID LOOP

(71) Applicant: Valeo Autosystemy Sp. z o.o., Skawina (PL)

(72) Inventors: Michal Belzowski, Skawina (PL); Filip Cichosz, Skawina (PL); Dawid Szostek, Skawina (PL); Karol Pokrywinski, Skawina (PL)

(73) Assignee: VALEO AUTOSYSTEMY SP. Z O.O, Skawina (PL)

( * ) Notice: Subject to any disclaimer, the term of this patent is extended or adjusted under 35 U.S.C. 154(b) by 677 days.

(21) Appl. No.: 17/438,631

(22) PCT Filed: Mar. 10, 2020

(86) PCT No.: PCT/EP2020/056361

§ 371 (c)(1),
(2) Date: Sep. 13, 2021

(87) PCT Pub. No.: WO2020/182817

PCT Pub. Date: Sep. 17, 2020

(65) Prior Publication Data

US 2022/0214086 A1 Jul. 7, 2022

(30) Foreign Application Priority Data

Mar. 14, 2019 (EP) ..... 19461518

(51) Int. Cl.
*F25B 39/04* (2006.01)
*F25B 43/00* (2006.01)
(Continued)

(52) U.S. Cl.
CPC ..... *F25B 39/04* (2013.01); *F25B 43/003* (2013.01); *F28F 9/0251* (2013.01); *F28F 19/01* (2013.01);
(Continued)

(58) Field of Classification Search
None
See application file for complete search history.

(56) References Cited

U.S. PATENT DOCUMENTS 5,557,945 A 9/1996 Mangyo et al.
5,901,573 A 5/1999 Kobayashi
(Continued)

FOREIGN PATENT DOCUMENTS

CN 201852383 U * 6/2011 ..... B21D 53/02
JP H11-257799 A 9/1999
(Continued)

OTHER PUBLICATIONS

KR20090046032A English Machine Translation (Year: 2009).*
(Continued)

*Primary Examiner* — Jenna M Maroney
(74) *Attorney, Agent, or Firm* — Osha Bergman Watanabe & Burton LLP

(57) ABSTRACT

Heat exchanger for a refrigerant fluid loop, the heat exchanger comprising at least one outlet configured to allow a refrigerant fluid to exit the heat exchanger, the heat exchanger comprising a core and a tank, that comprises said outlet, and the heat exchanger comprising at least one filter, wherein the at least one filter is adapted to filter the refrigerant fluid that exits the tank and in that the at least one filter is flat. The heat exchanger includes a connection block, housing the at least one filter, attached to the heat exchanger.

8 Claims, 6 Drawing Sheets

(51) Int. Cl.
*F28D 21/00* (2006.01)
*F28F 9/02* (2006.01)
*F28F 19/01* (2006.01)

(52) U.S. Cl.
CPC .. *F25B 2500/18* (2013.01); *F28D 2021/0068* (2013.01)

(56) References Cited

U.S. PATENT DOCUMENTS

| | | | | |
|---|---|---|---|---|
| 6,889,521 | B2 * | 5/2005 | Seno | F28F 9/002 62/509 |
| 2012/0186099 | A1 * | 7/2012 | Attarwala | F16L 13/103 29/428 |

FOREIGN PATENT DOCUMENTS

| | | | | | |
|---|---|---|---|---|---|
| JP | H11-304301 | A | | 11/1999 | |
| JP | 2006052938 | A | * | 2/2006 | F25B 39/04 |
| KR | 20080098243 | A | | 11/2008 | |
| KR | 20090046032 | A | * | 5/2009 | |

OTHER PUBLICATIONS

International Search Report and Written Opinion issued in corresponding International Application No. PCT/EP2020/056361, mailed May 8, 2020 (10 pages).
Office Action issued in European Application No. 19461518.3 mailed on Feb. 9, 2023 (4 pages).

* cited by examiner

Figure 2.1
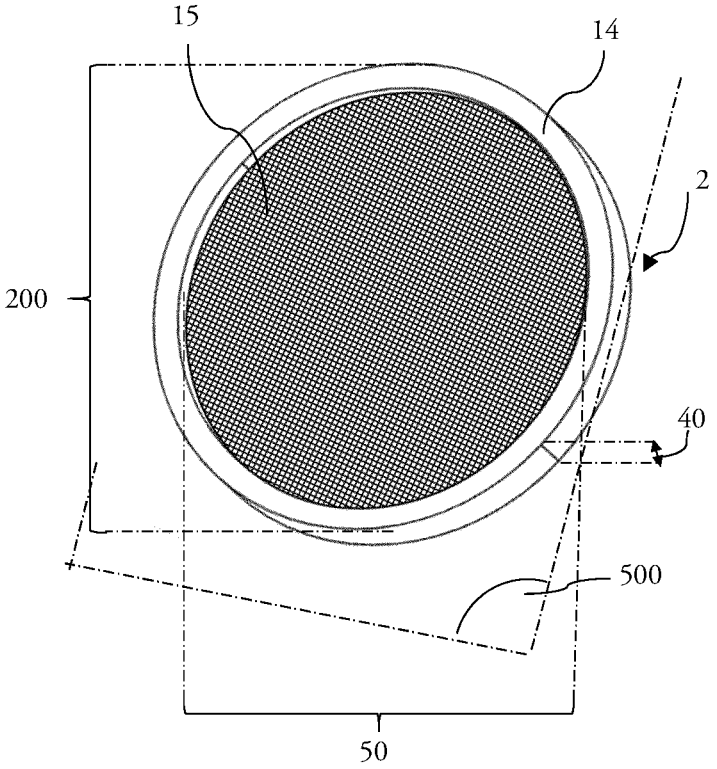

Figure 2.2
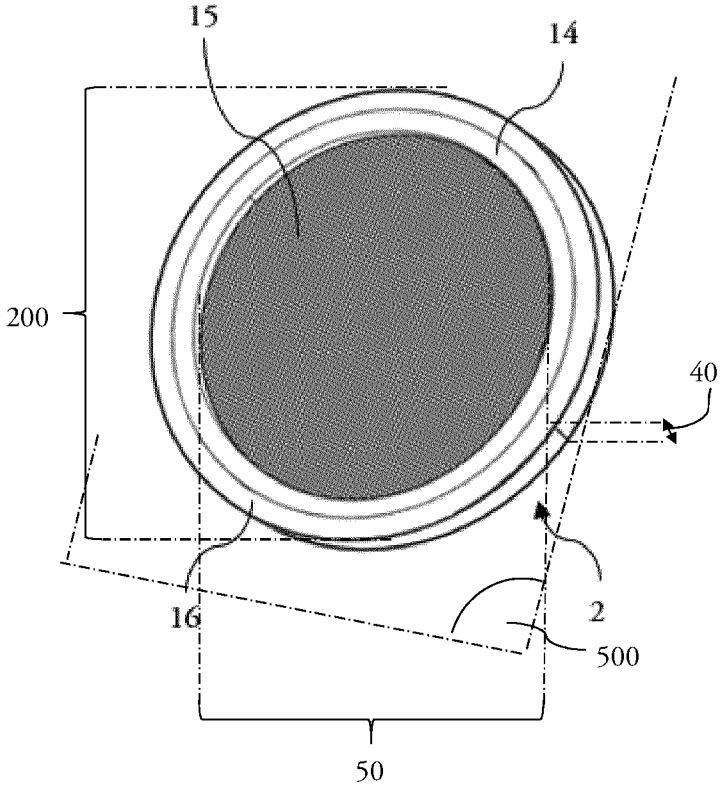

HEAT EXCHANGER WITH FILTER, FOR REFRIGERANT FLUID LOOP

The present invention relates to the domain of heat exchangers designed for refrigerant fluid loops. More specifically, the present invention concerns devices for filtering the refrigerant fluid that flows through such heat exchangers.

A refrigerant fluid loop generally comprises at least two heat exchangers, at least one compressor and at least one expansion device. The compressor and the expansion device are both fragile and comprise movable elements that can easily break. It is therefore important that only the refrigerant fluid enters this compressor or the expansion device. In order to achieve that goal, it is already known to filter the refrigerant fluid before it reaches one of these components.

However, some particles may be inside heat exchangers, for instance due to manufacturing processes or default in the cleaning system of such heat exchanger. The cleaning of such particles appears to be really expensive and complex. And even with all the care that can be given to this cleaning, some of those particles, especially particles that have a diameter equal or bigger than 60 μm can remain in those heat exchangers and can then be dragged by the refrigerant fluid to finally damage the compressor, the expansion device or any other element in which this refrigerant fluid could flow.

As a result, automotive suppliers are more and more concerned with this filtration, and they aim to filter even smaller particles than what is already filtered, in particular at the outlet of the heat exchanger.

Additionally, it is commonly known for filters to extend in the direction of the mass flow, said filters presenting an elongated shape which is often associated with a certain space congestion. Such filters are not always adapted for refrigerant loops and alternative configuration can be required.

The present invention solves at least these issues, by providing a heat exchanger for a refrigerant fluid loop, the heat exchanger comprising at least one outlet configured to allow a refrigerant fluid to exit the heat exchanger, the heat exchanger comprising a core and a tank that comprises said outlet and the heat exchanger comprising at least one filter. According to the invention, the filter is adapted to filter the refrigerant fluid that exits the tank and is flat.

According to one aspect of the present invention, the filter comprises at least one frame and at least one mesh element. The frame is arranged so that it surrounds and holds at least one mesh element while the mesh element extends in a flat area, forming the filtering part of the filter. The mesh element is defined by a surface referred to as meshed surface, and can, for instance, be configured to filter particles which present a diameter bigger than 50 μm. In other words, this filter is manufactured to retain particles which have at least such diameter, preventing them from reaching the rest of the refrigerant fluid loop where they could damage other components of such refrigerant fluid loop. Preferentially, this mesh element is either made of a synthetic material or of a metal.

More precisely, the mesh element is characterized in that the meshed surface is bigger than the surface of the outlet, referred to as outlet surface, said outlet surface being delimited by the outlet caliber. Such feature prevents important clogging of the space encompassing the filter. Indeed, particles accumulation can lead to a substantial reduction of both the mesh element surface and of the outlet surface, hence gradually contributing to both reduce the filter efficiency and alter the refrigerant fluid's flow. By providing a meshed surface bigger than the outlet surface, the present invention ensures that particles accumulation does not impact the outlet surface as much and thus potential clogging and alteration of the refrigerant fluid's flow are minimized.

According to a feature of the invention, the filter is arranged in a direction either substantially perpendicular or substantially parallel to the outlet surface. Alternatively, the filter can be angled, so that the induced congestion can be limited.

Advantageously, the filter can comprise at least one elastic band embedded around the frame. This elastic band function as a sealing device. It prevents refrigerant fluid leakages between the outlet of the heat exchanger and the filter as well as ensures that all of the refrigerant fluid passes through the filter and, as a result, is properly filtered. Such elastic band can, for example, consist in a rubber ring either overmolded or assembled on the frame.

The filter can adopt variable configurations. For instance, the filter can have a circular shape, that is to say that such filter comprises a circular base, the frame, from which extends a circular mesh element.

According to a feature of the invention, the heat exchanger comprises a connection block, the connection block comprising at least a pathway configured to allow the circulation of the refrigerant fluid. Such pathway extends between two opposite sides of the connection block, one extremity consisting in an entry for the refrigerant fluid, referred to as connection block entry, while the opposite extremity consists in an exit, referred to as connection block exit.

According to a first embodiment of the present invention, the connection block is design to house at least one filter, such filter being arranged transversally to a pathway so that all the refrigerant fluid flowing through the connection block is filtered. In such embodiment, the connection block also comprises a filtering chamber, consisting in an emptied space of the connection block. Said filtering chamber can be disposed between the connection block entry and the filter, in continuity with the pathway, and is defined by a chamber surface sensibly equal or larger than the meshed surface.

In other words, the filtering chamber is defined by an ensemble of points forming at least one internal wall of said chamber. Said internal wall or walls delimit, in a plan parallel to the meshed element of the filter when said filter is inserted in the connection block, the chamber surface. This chamber surface is correlated to the filter dimension, the filtering chamber being preferentially manufactured so that the filter can be inserted by simple sliding.

Preferentially, the filtering chamber is arranged directly at the level of the connection block extremity, or in a first tier of the connection block height, either at the level of the connection block entry or of the connection block exit.

Moreover, the connection block comprises at least one filtering cavity, said filtering cavity can, for instance, be arranged between the filter and the connection block exit and is defined by one cavity surface, sensibly equal or larger than the meshed surface. This cavity surface is measured according to a method similar to the one previously exposed for the measure of the chamber surface. The filtering cavity is preferentially disposed in continuity with the filtering chamber, both entities being separated, and hence delimited, by the filter, as well as traversed by the pathway. That way, refrigerant fluid flowing through the block will successively pass through the filtering chamber, the filter and finally the filtering cavity. It is understood that this is an example and that the filtering chamber and the filtering cavity positions can be reversed, the invention previously exposed being in no way limitative. The connection block layout or the components positions can, for instance, easily be modified insofar as they fulfil the functionalities According to a feature of this first embodiment, the connection block can be brazed to the heat exchanger. For instance, the connection block can be arranged so that the connection block entry is directly connected to the outlet of the tank. In such configuration, the filter is disposed in a direction sensibly parallel to the outlet surface, and so are the filtering chamber and the filtering cavity.

The brazing operation prevents refrigerant fluid leakages and, as a result, the pathway arranged inside the connection block directly extends the outlet of the heat exchanger in order to make sure that all the refrigerant fluid that exits the heat exchanger reaches the path of the block.

Alternatively, a connection pipe can be interposed between the outlet of the tank and the connection block, such connection pipe being able to carry the refrigerant fluid in order for this refrigerant fluid to reach the first orifice of the block once out of the heat exchanger. The connection block is arranged so that the filter either presents a direction sensibly perpendicular or sensibly parallel to the outlet surface. Advantageously, the block can either be placed away from the heat exchanger or brazed to the heat exchanger.

According to a second embodiment, the heat exchanger comprises a connection pipe, said connection pipe extending between an intermediate block, arranged at the outlet of the tank, and a connection block. Both intermediate block and connection block are preferentially brazed to the heat exchanger. In such embodiment, the filter is integrated in the connection pipe, said pipe being defined by a pipe caliber, which delimits a pipe surface. More specifically, the filter presents a meshed surface larger than the pipe surface and the filter is integrated in a filtering chamber. The filtering chamber is disposed in an intermediate part of the connection pipe, thus subdividing the connection pipe into two distinct portions. A first portion of the connection pipe extend between the intermediate block and the filtering chamber while a second portion of the connection pipe extend between the filtering chamber and the connection block. In other words, according to this second embodiment, the refrigerant fluid exiting the heat exchanger successively flows through the intermediate block, a first portion of the connection pipe, the filtering chamber comprising at least one filter and then through a second portion of the connection pipe and the connection block.

More precisely, the filtering chamber consists in a closed container, configurated to fully house at least one filter. Such filtering chamber comprises at least two apertures, a first aperture through which the refrigerant fluid enters the filtering chamber, and a second aperture through which the refrigerant fluid exits the filtering chamber. Said first and second apertures are, preferentially, disposed on opposite edges of the filtering chamber so that the filter separates them, the filter being disposed in a direction sensibly perpendicular to the outlet surface.

The invention cannot be limited to the characteristics and configuration previously exposed. It can be extended to any equivalent means and configuration and to any technically operative combination of such means. In particular, the shape of the flat filter, its diameter, the volume of the filtering chamber can be modified insofar as they fulfil the functionalities of the invention. For instance, several filters, each manufactured to retains particles of variable diameters could be combined. Similarly, at least one filter could be disposed in a direction sensibly angled compared to the outlet surface, and so forth.

According to the invention, the heat exchanger can be configured to undertake a heat exchange between the refrigerant fluid and an airflow. For example, this airflow can be taken outside a motor vehicle the heat exchanger is intended to. Alternatively, the heat exchanger can be configured to undertake a heat exchange between the refrigerant fluid and a coolant. According to this alternative, the heat exchanger of the invention is arranged at an interface between the refrigerant fluid loop and a coolant loop. In other words, the heat exchanger comprises at least a first chamber through which the refrigerant fluid flows and a second chamber through which the coolant flows. Such coolant can for example be water.

For instance, the heat exchanger according to the invention can be used as a condenser. In other words, the heat exchanger is then configured to liquefy the refrigerant fluid that flows through it, that is to say that the refrigerant fluid enters the heat exchanger in a gaseous state and exits it in a liquid state.

Other features, details and advantages of the invention can be inferred from the specification of the invention given hereunder. Various embodiments are represented in the figures, wherein:

FIG. 1 is a schematic cross-section of the interface between one heat exchanger and a connection block, comprising a filter, arranged according to a first embodiment of the invention;

FIG. 2.1 is a schematic representation of the filter according to a first configuration;

FIG. 2.2 is a schematic representation of the filter according to a second configuration;

Figure 1:
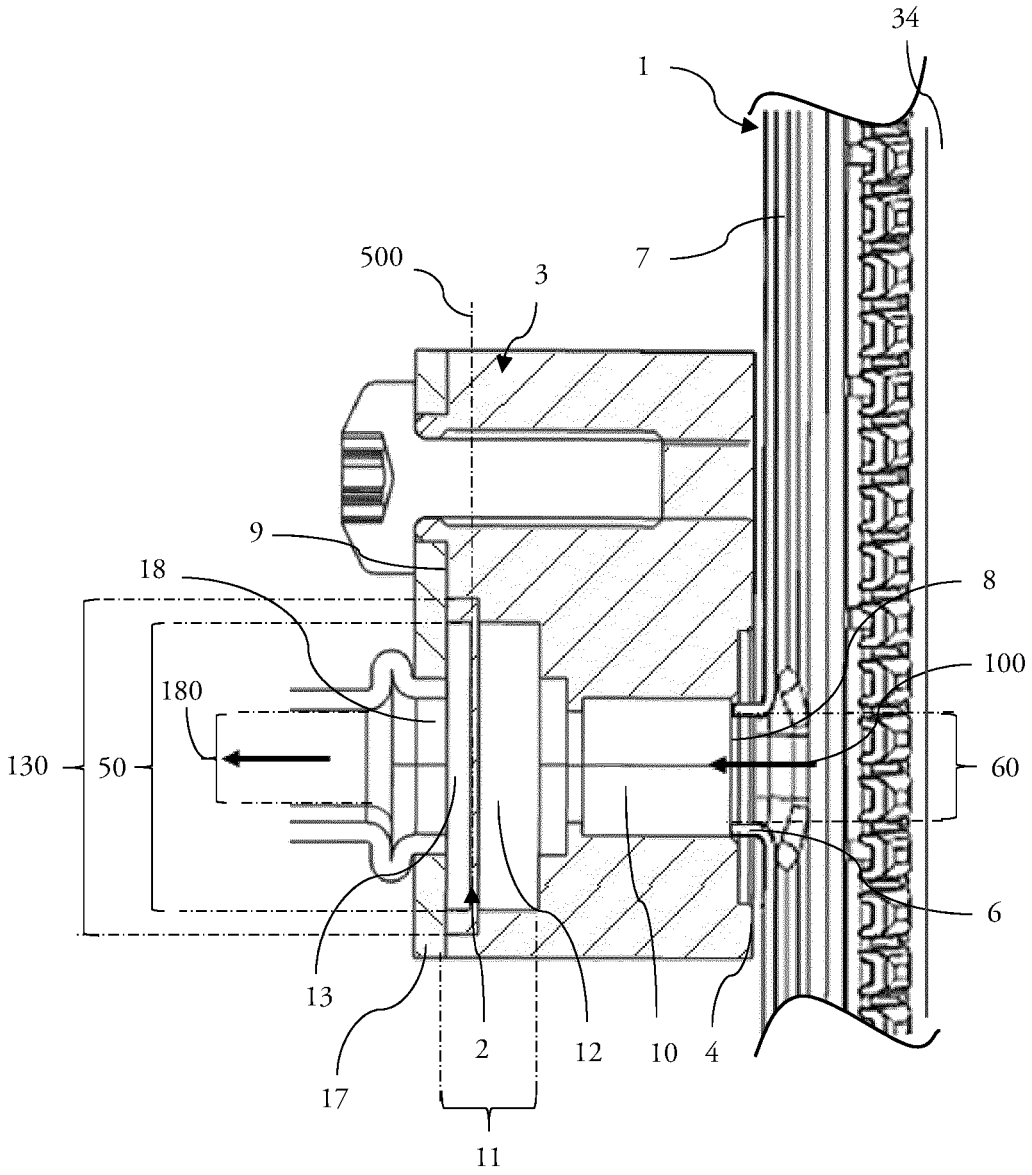

FIG. 1 is a schematic cross-section of a heat exchanger 1 comprising at least a filter 2, a tank 7 and a core 34, the filter 2 being, in this first embodiment, housed in a connection block 3. The filter 2 is detailed in FIG. 2.1 and FIG. 2.2 while FIG. 1 illustrates its arrangement within the connection block 3. More especially, the FIG. 1 illustrates the interface between an outlet 6 of the tank 7 and the connection block 3.

As illustrated in FIG. 1, in this first embodiment the connection block 3 is arranged on the heat exchanger 1. More especially, the connection block 3 is brazed on the outlet 6, along a flowing direction of a refrigerant fluid 100 exiting the heat exchanger 1, this flowing direction being illustrated by arrows. At least one side of the connection block 3 is configurated to cooperate with the outlet 6. As illustrated such cooperation can be operated by an orifice, integrated in a first side 4 of the connection block 3, this orifice being referred to as connection block entry 8, hence resulting into an entry for the circulating refrigerant fluid 100. The outlet 6 can be compared to a collar extending outside the heat exchanger 1 and away from the tank 7. The caliber of such outlet 6 defines a surface, called outlet surface 60, extending in a direction sensibly parallel to the tank 7.

The connection block 3 basically consists in a single block, comprising a hollowness extending from the connection block entry 8 to an opposite side 9 of the connection block 3 in a direction sensibly perpendicular to the outlet surface 60. As a result, the hollowness creates a pathway 10 passing through the connection block 3 and communicating with the tank 7. The cooperation existing between the outlet 6 and the first side 4 of the connection block 3 as well as the disposition of the pathway 10 in continuity with the outlet 6 allows the refrigerant fluid 100 to directly flow from the heat exchanger 1 to the opposite side 9 of the connection block 3.

The connection block 3 is configurated to integrate at least one filter 2. A first portion of the connection block, referred to as a housing portion 11, can, as illustrated, be disposed so that it neighbours the opposite side 9. Alternatively, and as exposed in other figures, the housing portion 11 can be disposed at the level of the first side 4 of the connection block 3.

The housing portion 11 comprises various means aiming to contain and hold the filter 2, all of which will be detailed later on in FIG. 4. Basically, at least one extremity of the pathway 23 is enlarged, and extends in every direction in a plan sensibly parallel to the outlet surface 60, hence forming at least a filtering chamber 12 and/or a filtering cavity 13. Said filtering chamber 12 and/or filtering cavity 13 are opened on two opposite faces. A first face is opened toward the connection block entry 8, while a second face is opened away from said entry. That way, the pathway 10, as well as the refrigerant fluid 100, passes through the filtering chamber 12 and/or the filtering cavity 13.

Such arrangement permits the insertion of at least one filter 2 either in the filtering chamber 12, in the filtering cavity 13 or both in the filtering chamber 12 and the filtering cavity 13. More specifically, in the first embodiment of the invention, represented in FIG. 1, the filter 2 is arranged in the filtering cavity 13, in a direction sensibly transversal to the pathway 10 and sensibly parallel to the outlet surface 60. The filter 2 can also, alternatively, be disposed so that it is angled compared to the outlet surface 60.

The filter 2 can be observed in detail in FIG. 2.1 and FIG. 2.2. According to a first configuration of the filter 2, the filter 2 comprises at least a frame 14 and at least a mesh element 15. The mesh element 15 extends in a flat area, integrated in a plan 500, forming the filtering part of the filter 2. Particularly the mesh element 15 is manufactured to filter particles presenting a diameter sensibly bigger than 50 μm and can be made out of either a synthetic material or a metal. It is understood that this is only an example and that the mesh element 15 can be modified and adapted to retain particles of different diameters without departing from the invention. The frame 14 is arranged so that it surrounds and holds at least one mesh element 15, the frame 14 defining a meshed surface 50, corresponding to a surface of the mesh element 15 not obstructed by the frame 14 and able to filter the refrigerant fluid 100 flowing through.

Additionally, and as represented on FIG. 2.1 and FIG. 2.2, the filter 2 can comprise at least one elastic band 16 embedded around the frame 14. The addition of such elastic band 16 contributes to the sealing of the connection block 3 upon the filter 2 integration in the connection block 3, thus preventing refrigerant fluid leakages. Such elastic band 16 can, as illustrated, consist in a rubber ring either overmolded or assembled on the frame 14. Particularly, both the frame 14 and the elastic band 16 extend perpendicularly to the plan 500 defined by the mesh element 15, hence defining a filter thickness 40, corresponding to the height of the frame 14 and/or the elastic band 16 of the filter 2, measured according to an axis sensibly perpendicular to the mesh element plan 500. A filter surface 200 defines the overall surface of the filter 2, measured according to the mesh element plan 500. Such filter surface 200 varies, depending on whether the filter 2 comprises an elastic band 16 or not.

As previously exposed, when inserted in the connection block 3, the filter 2 is placed either in the filtering chamber 12 or the filtering cavity 13. As it can be observed on FIG. 1, once inserted, the filter 2 is locked in the connection block 3 by the anchoring of a cap 17, equipped on the opposite side 9 of the connection block 3. The cap 17 can also be arranged in the first side 4 of the connection block 3, depending on where the housing portion 11 is disposed. Said cap 17 comprises at least one orifice arranged in continuity with the pathway 23 and with the filtering chamber 12 and/or the filtering cavity 13, hence forming a connection block exit 18. The connection block exit 18 is defined by a surface, referred to as exit surface 180, such surface being preferentially smaller than the surface of the filtering chamber 12.

As a result, when the refrigerant fluid 100 flows through the connection block 3, more precisely from the connection block entry 8 to the connection block exit 18, it passes through the filter 2 and particles larger than 50 μm are retained. The cooperation between the filter 2 and the connection block 3 will be further detailed in FIG. 4.

Figure 3:
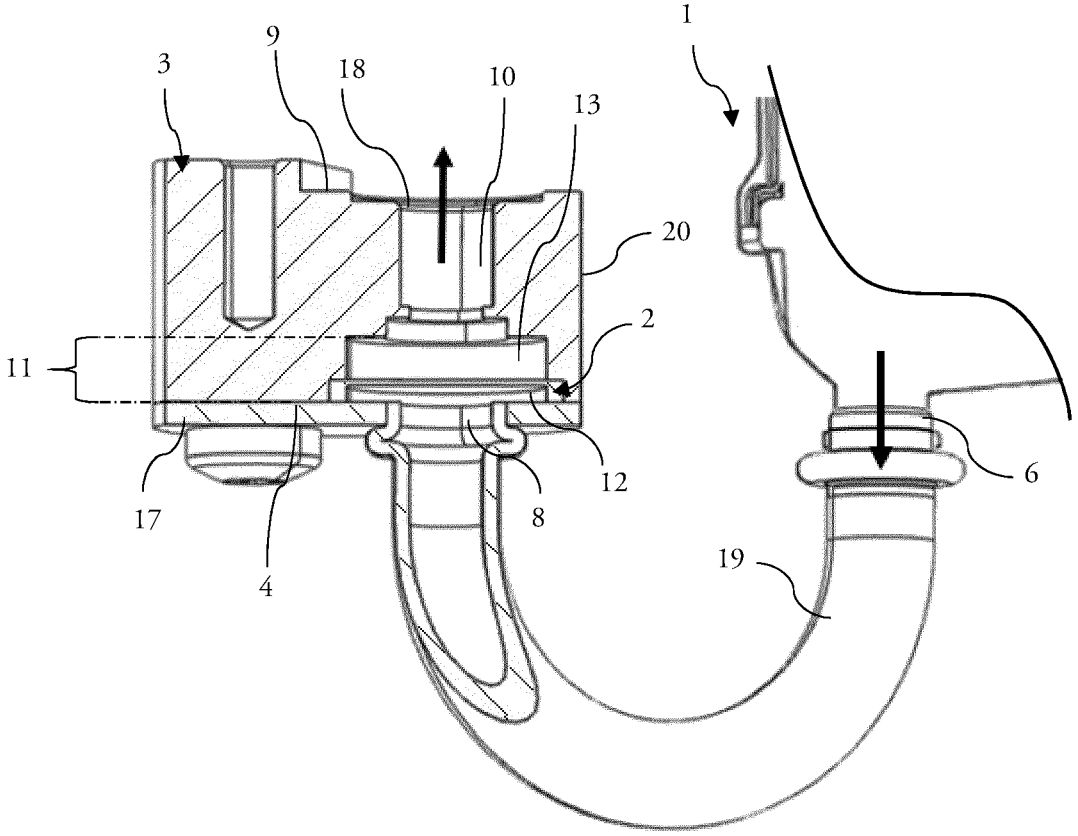
FIG. 3 is a cross-section of a connection block, when arranged according to an alternative of the first embodiment.

The FIG. 3 illustrates an alternative to the first embodiment, exposed hereabove. For the sake of brevity, some of the features shared by both alternatives will not be described again.

The present alternative differs from the first embodiment essentially in the fact that a connection pipe 19 is interposed between the heat exchanger 1 and the connection block 3 comprising the filter 2, and more especially between the outlet 6 of the tank of the heat exchanger 1 and the connection block 3. Such connection pipe 19 is brazed to the outlet 6 and to the connection block entry 8 and is able to carry the refrigerant fluid 100 to the connection block 3.

The connection block 3 roughly conserves the same features as previously exposed. However it is arranged so that the refrigerant fluid 100 first passes first through the housing portion 11 of the connection block 3, integrating the filter 2, and then through the pathway 10 extending in continuity with the connection block entry 8. The filtering cavity 13 and/or the filtering chamber 12 are partially closed on one side by the anchoring of the cap 17. A difference of such alternative relies in the fact that the cap 17 is fixed on the first side 4 and comprises the connection block entry 8, and not the connection block exit 18 as previously exposed. In other words, while the general arrangement of the connection block 3 is conserved, it is reversed.

As such alternative arrangement of the connection block 3 does not affect its efficiency or its ability to filter, it could be envisioned to invert the connection block 3 position so that it adopts a configuration similar to the one exposed in FIG. 1.

In this alternative, the outlet 6 is represented extending from a bottom part of the heat exchanger 1, it can however be disposed on the side of said heat exchanger 1, as previously represented in FIG. 1, the filter 2 can thus be disposed in a direction sensibly parallel or sensibly perpendicular to the outlet surface 60 depending on how the connection block 3 is arranged. The filter 2 is, however, preferentially disposed in a direction parallel to the connection block entry 8.

In the FIG. 3 the pathway 10 extends in a direction sensibly parallel to an outlet surface 60 of the tank 7. The filter 2 is arranged transversally to the pathway 10 and is sensibly perpendicular to the outlet surface 60. In such variant, the refrigerant fluid 100 enters by the connection block entry 8, flows successively through the filter chamber 12, the filter 2 and the filtering cavity 13, all of which are part of the housing portion 11 of the connection block 3. Then the refrigerant fluid 100 flows through the pathway 10 before exiting the connection block 3 through the connection block exit 18, situated in the opposite side 9.

Unlike the first embodiment, the present connection block 3 can be disposed away from the heat exchanger 1. In other words, according to this alternative, the connection block 3 is arranged away from the heat exchanger 1, but is still as part of the heat exchanger 1, because this connection block 3 is a one-component with the rest of the heat exchanger 1 and it connects the heat exchanger 1 to the refrigerant fluid loop.

Optionally and according to an alternative which is not illustrated here, a lateral side 20 of the connection block 3 can be brazed on the heat exchanger 1, away from the outlet 6, while the connection block entry 8 is connected to the heat exchanger 1 outlet 6 through a connection pipe 19.

We will now expose in detail the connection block 3 and the filter 2 integration in said connection block 3. The FIG. 4 is a cross-section of the connection block 3, such connection block 3 being similar to what was previously represented, in FIG. 3, in the first embodiment alternative. For the sake of clarity, the filter 2 will be represented without an elastic band.

As previously stated, the connection block 3 can consist in a single block. One side of the connection block 3 comprises the connection bloc exit while the opposite side of the connection block 3 is arranged to comprise at least one filtering chamber 12 and/or one filtering cavity 13 is dedicated to the housing of at least one filter 2. The sides of the connection block 3 that does not comprise either the filtering chamber, and/or the filtering cavity, or the connection block exit can be referred to as lateral sides 20.

The pathway 10 extend in the direction of an axis 150, sensibly parallel to the lateral sides 20, and connect successively the connection block exit 18 to the filtering cavity 13 and then to the filtering chamber 12. Such continuity will ensure that the refrigerant fluid 100 properly passes through the connection block 3, flowing in the direction of the axis 150.

The connection block 3 is configurated to integrate at least one filter 2. In order to do so the cap 17 is detached from the first side 4 of the connection block 3, hence giving access to the filtering chamber 12 and/or filtering cavity 13. That way, at least one filter 2 can be directly inserted in the connection block 3, either in the filtering chamber 12 or the filtering cavity 13.

Figure 4:
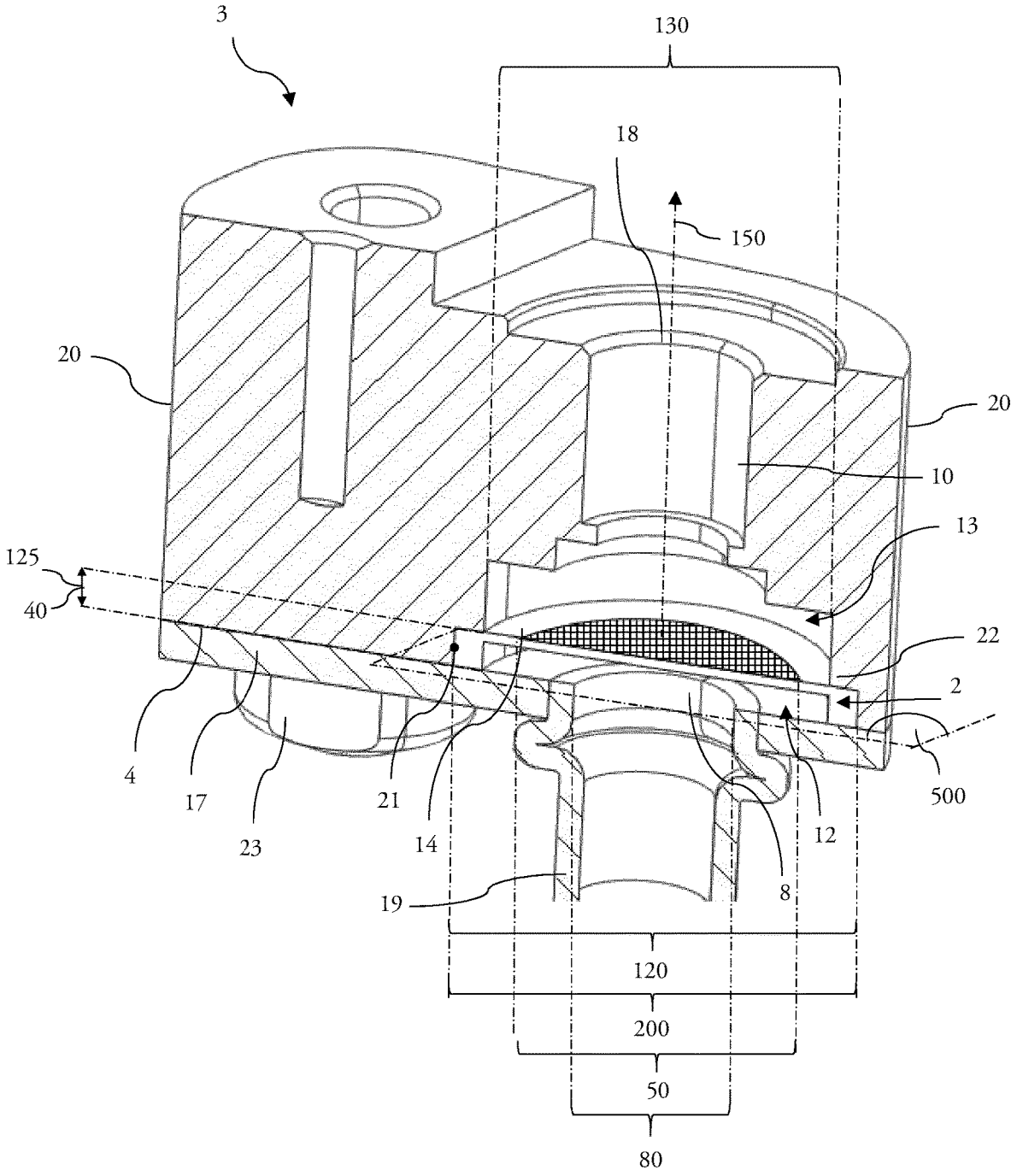
FIG. 4 is a cross-section of the connection block represented in FIG. 1, the filter arrangement within said connection block being visible.

In the example illustrated in FIG. 4, the filter 2 is arranged in the filtering chamber 12, in a direction sensibly transversal to the pathway 10 and perpendicular to the axis 150, said axis being parallel to the direction 150 the pathway 10 extends into. The filtering chamber 12 presents a chamber surface 120 sensibly equal, or larger, than the meshed surface 50 of the filter 2. Preferentially, and as illustrated, the surface chamber 120 should permit the insertion of the filter 2 but should not favour the movement of said filter 2 within the filtering chamber 12. Furthermore, when the filter 2 comprises an elastic band 16, such parameter should be taken into account and the size of the filtering chamber 12 should be consequently adapted.

Within the filtering chamber 12, an ensemble of points can be described as forming at least one chamber internal wall 21 of the filtering chamber 12. The chamber surface 120 is defined by a subset of said points, comprised within a plan, parallel to the mesh element plan 500. For instance, in FIG. 4, the filtering chamber 12 adopts a circular shape. The ensemble of points forms a unique chamber internal wall 21, comparable to a cylinder opened on two opposite edges. Variants can be envisioned, for example a cubic filtering chamber 12, and so on. The same principles can be applied to the filtering cavity 13, said filtering cavity 13 being defined by at least one cavity internal wall and its resulting cavity surface 130. For each variant, the filter 2 adopts a shape complementary to that of the filtering chamber 12 and/or the filtering cavity 13, depending on where it is disposed. That way, the proper sealing of the filtering chamber 12 and/or the filtering cavity 13 is ensured. In other word, when the shape and the dimensions of the filtering chamber 12, and/or the filtering cavity 13, and that of the filter 2 coincide, refrigerant fluid 100 leakages around the filter 2 will be prevented. Moreover, such configuration ensure that all of the refrigerant fluid 100 passes through the filter 2, and thus that all particles bigger than 50 μm are retained.

By inserting the filter 2 within the filtering chamber 12, we create a partial barrier between the filtering chamber 12 and the filtering cavity 13. The filtering cavity 13 extends from the filter 2 toward the connection block exit 18, while the filtering chamber 12 extends from the filter 2 and away form said connection block exit 18. Particularly, in the example illustrated, the filtering chamber 12 extends toward the cap 17, when said cap 17 is attached to the connection block 3, and toward the connection block entry 8 said cap 17 comprises.

According to a preferred configuration, illustrated in FIG. 4, in order to permit the insertion of the filter 2 while preventing the movement of said filter 2 within the filtering chamber 12, the filtering chamber 12 should presents a chamber surface 120 larger than the meshed surface 50, and sensibly equal to the filter surface 200. In order to minimize the clogging provoked by particles accumulation around the filter, it is a feature of the present invention to present a meshed surface 50, larger than the outlet surface, and hence larger than an entry surface 80. Thus, the meshed surface 50 can, for instance, be extended so that it is sensibly equal or larger than the cavity surface 130. The meshed surface 50 possible range extend between a surface sensibly equal or larger than entry surface 80 and a surface strictly smaller than the filter surface 200.

Furthermore, the filtering cavity 13 presents a cavity surface 130 smaller than the chamber surface 120 of the filtering chamber 12, but preferentially equal or larger than the meshed surface 50. Such surface difference results in a stop block 22, consisting in a protrusion of an internal portion of the connection block 3 sensibly parallel to the mesh element plan 500.

In order to ensure the proper anchoring of the filter 2 within the filtering chamber 12, the stop block 22 is configured so that it cooperates with the frame 14 and/or the elastic band 15 of the filter 2. Indeed, the filtering chamber 12 is also characterized by a chamber depth 125, corresponding to the length measure between the stop block 22 and the opposite part of the filtering chamber 12 and according to a direction parallel to the axis 150. In other word, when the cap 17 is anchored on the connection block 3, the chamber depth 125 is sensibly equal to the distance between the stop block 22 and the cap 17.

As illustrated, such chamber depth 125 is sensibly equal to the filter thickness 40, said filter thickness 40 being previously described as the height of the frame 14 and/or of the elastic band of the filter 2, measured according to the axis 150 sensibly perpendicular to the mesh element plan 500. That way, when the filter 2 is inserted in the filtering chamber 12 and the cap 17 is anchored on the connection block 3, both the cap 17 and the stop block 22 are in contact with the frame 14 and/or the elastic band of the filter 2, hence preventing any movement of the filter 2 along the axis 150.

In a variant, not represented in the present document, additional filters can be inserted within the connection block 3. For instance, the filtering chamber 12 can integrate multiple filters 2, each placed one after another following the axis 150. In such configuration, the filtering chamber 12 would be modified and present a chamber depth 125 adapted to the insertion of several filters 2, each defined by their own filter thickness 40. Additionally, the filter 2 can be disposed so that it is angled within the filtering chamber 12.

Additionally, it could be possible to place at least a second filter 2 within the filtering cavity 13. Such filter 2 could be manufactured to filter the same particle size or not. For instance, a filter 2 prone to stop bigger particles could be placed directly at the level of the connection block entry 8, while filters 2 apt to retain smaller particles could be disposed further down the axis 150, either within the same filtering chamber 12 or separated between said filtering chamber 12 and the filtering cavity 13.

As exposed hereabove, the filter 2 is kept in place within the filtering chamber 12 by the cap 17. In order to attach said cap 17 to the connection block 3 at least one anchoring mean 23 is required. As illustrated in FIG. 4, such anchoring mean 23 can consists, for instance, in a screw attaching the cap 17 to the connection block 3, and thus holding the filter 2. Other anchoring means 23 could however be considered.

As mentioned above, the connection block 3 is configured so that the connection block entry 8, the filtering chamber 12 and/or the filtering cavity 13, the pathway 10 and the connection block exit 18 are all placed in continuity with each other. That way a path is defined for the refrigerant fluid 100 to flow through, such path being hampered by at least one filter 2. That path is arranged so that all of the refrigerant fluid 100 exiting the outlet 6 of the heat exchanger 1 is sent flowing through the connection pipe 19 so that it reaches the filter 2. Such connection block 3 can also be arranged according to the first embodiment of the present invention, as well as its alternatives.

Figure 5:
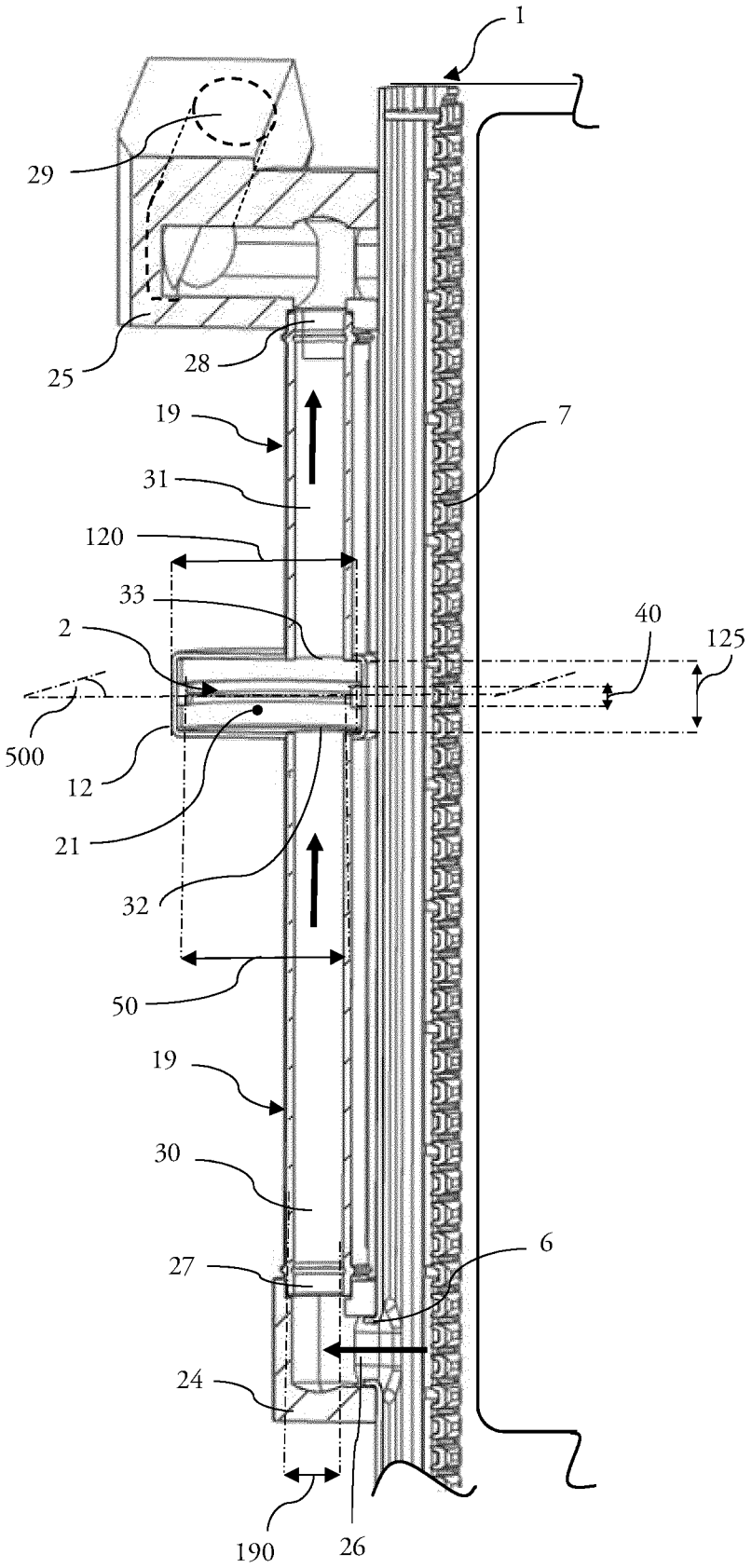
FIG. 5 is a cross-section of a heat exchanger comprising a filter, arranged according to a second embodiment of the invention.

As detailed hereafter, the filter 2 can also be disposed within the heat exchanger 1 according to a second embodiment. Such embodiment is illustrated on FIG. 5 and differs from the first embodiment in the fact that the filter 2 is not arranged within a connection block 3 but within a simple filtering chamber 12.

To achieve this second embodiment, the heat exchanger 1 comprises a connection pipe 19, said connection pipe 19 extending in a direction parallel to the tank 7 and between a first intermediate block 24, arranged at the outlet 6 of the tank 7, and a second intermediate block 25. Both the intermediate block 24 and the second intermediate block 25 are brazed to the heat exchanger 1.

The intermediate block 24 can consist in a single piece element and comprises a hollowness. Such hollowness extends, for instance, from a first side of the intermediate block to an adjacent side of the intermediate block 24 forming respectively an intermediate block entry 26 and exit 27. The intermediate block entry 26 is configured to cooperate with the tank 7 outlet 6 and is directly connected to the refrigerant fluid loop in a way that prevent any leakage of said fluid. The intermediate block exit 27 is configured to receive the connection pipe 19.

Similarly, the second intermediate block 25 comprises a hollowness resulting into a second intermediate block entry 28, cooperating with the connection pipe 19, and a second intermediate block exit 29. Both first and second intermediate block 24, 25 presenting similar configurations, their position can easily be reversed, the present arrangement being, by no mean, limitative.

In such embodiment, the filter 2 is integrated within the connection pipe 19, said pipe being defined by a pipe caliber, which delimits a pipe surface 190. The filter 2 is arranged in a direction sensibly transversal to the connection pipe 19 and parallel to the outlet surface 60, its mesh element defining the mesh element plan 500, sensibly perpendicular to the connection pipe 19. That way, the filter 2 is sensibly perpendicular to the global direction of the refrigerant fluid 100 direction. The filter 2 presents a meshed surface 50 larger than the pipe surface 190 and is integrated in a filtering chamber 12. As a result, the filtering chamber 12, and thus the filter 2, protrudes from the connection pipe 19.

The filtering chamber 12 is disposed in an intermediate part of the connection pipe 19. It subdivides the connection pipe 19 into two distinct portions, a first portion of the connection pipe 30, extending between the first intermediate block 4 and the filtering chamber 12, and a second portion of the connection pipe 31, extending between the filtering chamber 12 and the second intermediate block 25. The filtering chamber 12 is defined by a chamber surface 120, delimited by at least one internal wall 21 of said filtering chamber 12 and measure in a plan sensibly perpendicular to the connection pipe 19 direction. In order to ensure a proper cooperation between the filter 2 and the filtering chamber 12, it is preferred for the surface chamber 120 to be sensibly equal to the filter surface 200. That way all of the refrigerant fluid passes through the filter 2.

The filtering chamber 12 consists in a closed container comprising two apertures, each being disposed on opposite faces of the filtering chamber. A first aperture 32 is connected to the first portion of the connection pipe 30, while a second aperture 33 is connected with the second portion of the connection pipe 31.

Rather than presenting a chamber depth 125 sensibly equal to the filter thickness 40, as it was previously the case in the first embodiment, the filtering chamber 12 is preferentially configured so that its chamber depth 125, or in other words its height, is bigger than the filter thickness 40. Additionally, the filtering chamber 12 can comprise at least one chamber anchoring mean, not represented here, disposed at the level of its internal wall or walls 21. Such chamber anchoring mean permits the proper attachment of the filter 2 within the filtering chamber 12 and prevent its movement. Alternatively, the filter 2 can be brazed within the filtering chamber 12 or several filters 2 can be disposed within the same filtering chamber 12, said filtering chamber 12 presenting a chamber depth 125 sensibly equal to the sum of the different filters thicknesses 40.

According to variants, several filtering chamber 12 could be disposed along the connection pipe 19, each housing at least one filter 2, or said filter 2 could be placed so that they are angled within the filtering chamber 12.

It will be understood from the foregoing that the present invention provides a simple, easily adaptable and easily replaceable means to filter the refrigerant fluid that exit a heat exchanger accommodated on a refrigerant fluid loop so as to prevent any damage on other components of such a refrigerant fluid loop.

However, the invention cannot be limited to the means and configurations described and illustrated herein, and it also extends to any equivalent means or configurations and to any technically operative combination of such means. In particular, the shape and arrangement of the block and/or the filter can be modified insofar as they fulfil the functionalities described in the present document.

The invention claimed is:

1. A heat exchanger for a refrigerant fluid loop, the heat exchanger comprising:

at least one outlet configured to allow a refrigerant fluid to exit the heat exchanger;

a core;

a tank that comprises said at least one outlet;

at least one filter, wherein the at least one filter is adapted to filter the refrigerant fluid that exits the tank and wherein said at least one filter is flat;

wherein the at least one filter comprises at least one frame and an elastic band, the elastic band being embedded around the at least one frame, wherein the at least one filter comprises at least one flat mesh element configured to filter the refrigerant fluid, said at least one frame surrounding the at least one flat mesh element, wherein the at least one flat mesh element is defined by a meshed surface and the at least one outlet of the tank is defined by an outlet surface, the meshed surface being bigger than the outlet surface; and a connection pipe extending between a first intermediate block arranged at the outlet of the tank and a second intermediate block, said connection pipe integrating the at least one filter, wherein the second intermediate block is brazed on the heat exchanger, wherein the meshed surface is larger than a connection pipe surface, wherein said connection pipe surface is delimited by a pipe calibre, wherein said at least one filter is housed in a filtering chamber arranged so that the refrigerant fluid flows successively through a first portion of the connection pipe, then through the filtering chamber comprising the at least one filter and then through a second portion of the connection pipe.

2. The heat exchanger according to claim 1, wherein the at least one filter is arranged in a direction either perpendicular or parallel to the outlet surface.

3. The heat exchanger according to claim 1, wherein the filtering chamber consist in a closed container configurated to fully house the at least one filter and comprising at least two apertures, a first aperture through which the refrigerant fluid enters the filtering chamber, and a second aperture through which the refrigerant fluid exits the filtering chamber.

4. The heat exchanger according to claim 3, wherein the first aperture and the second aperture are arranged on opposite edges of the filtering chamber and separated by the at least one filter, said at least one filter being disposed in a direction perpendicular to the outlet surface.

5. The heat exchanger according to claim 1, wherein the heat exchanger is configured to undertake a heat exchange between the refrigerant fluid and an airflow.

6. The heat exchanger according to claim 1, wherein the heat exchanger is configured to undertake a heat exchange between the refrigerant fluid and a coolant.

7. The heat exchanger according to claim 1, wherein the heat exchanger is used as a condenser.

8. The heat exchanger according to claim 1, wherein the at least one filter is configured to retain particle that present a diameter bigger than 50 μm.

* * * * *